United States Patent [19]

Huppert

[11] Patent Number: 4,907,378

[45] Date of Patent: Mar. 13, 1990

[54] FLAP WHEEL ASSEMBLY

[75] Inventor: James C. Huppert, Hudson, Wis.

[73] Assignee: Minnesota Mining and Manufacturing Company, Saint Paul, Minn.

[21] Appl. No.: 270,546

[22] Filed: Nov. 14, 1988

[51] Int. Cl.[4] ..... B24B 9/02

[52] U.S. Cl. ..... 51/330; 51/337

[58] Field of Search ..... 51/206 R, 330, 332, 51/334, 337

[56] References Cited

U.S. PATENT DOCUMENTS

| | | | |
|---|---|---|---|
| 2,821,819 | 2/1958 | Bernstein et al. | 51/193.5 |
| 2,826,776 | 3/1958 | Peterson | 15/179 |
| 2,871,632 | 2/1959 | Cosmos | 51/193.5 |
| 2,921,329 | 1/1960 | Peterson | 15/182 |
| 2,982,006 | 5/1961 | Booth | 51/206 R |
| 3,533,198 | 10/1970 | Burns | 51/337 |
| 3,645,049 | 2/1972 | Freerks et al. | 51/334 |
| 3,678,633 | 7/1972 | Block | 51/337 |
| 3,869,833 | 3/1975 | Belanger | 51/334 |
| 4,133,146 | 1/1979 | De Cola | 51/336 |
| 4,217,737 | 8/1980 | Hasegawa | 51/334 |

*Primary Examiner*—Frederick R. Schmidt

*Assistant Examiner*—M. Rachuba

*Attorney, Agent, or Firm*—Donald M. Sell; Walter N. Kirn; William L. Huebsch

[57] ABSTRACT

A hub for a flap wheel assembly adapted to finish an arcuate convex surface. The hub has a central cross section around its axis with a circular periphery of a first diameter, opposite circular end cross sections axially spaced on opposite sides of the central cross section and having circular peripheries of second diameters substantially larger than the diameter of the central cross section, and a peripheral surface comprising a multiplicity of generally straight elongate surface segments extending between the peripheries of the end cross sections across and contacting the periphery of the central cross section with each segment crossing at a different radius of the central cross section from the axis of the hub and being disposed at the same angle with respect to the axis measured about the radius crossed by the surface segment. A plurality of slots along and generally parallel to the segments each are adapted for holding a straight edge portion of a generally rectangular flap member with the width of the flap member projecting outwardly of the hub.

9 Claims, 5 Drawing Sheets

FLAP WHEEL ASSEMBLY

TECHNICAL FIELD

The present invention relates to flap wheel assemblies, and in particular to flap wheel assemblies adapted to finish or abrade an arcuate or generally cylindrically convex surfaces.

BACKGROUND ART

The art is replete with flap wheel assemblies comprising a central hub, a plurality of flap members that extend the length of the hub, and means for holding edge portions of the flap members in spaced relationship around the peripheral surface of the hub with the width of the flap members (e.g., pads of abrasive material or brushes) projecting outwardly of the hub to afford, upon rotation of the hub about its axis, engaging distal portions of flap members with a surface of a work piece to abrade or otherwise finish the surface. U.S. Pat. Nos. 2,821,819; 2,871,632; 2,921,329; 3,533,198; 3,645,049; 3,869,833; 4,133,146 and 4,217,737 provide illustrative examples. In many such flap wheel assemblies the flap members are rectangular and are attached so that the flap members extend parallel to the axis of the hub and in use the entire width of a flap engages a work piece at once. As is illustrated in U.S. Pat. Nos. 2,921,329 and 4,217,737, however, the flap members may alternately be disposed in a helical pattern along the periphery of the hub which is known to quiet the operation of the flap wheel assembly due to the sequential engagement of each flap with a work piece. Straight flap members have also been disposed on a cylindrical hub slightly out of parallel with its axis (i.e., angled at about six degrees) to provide a small measure of sequential engagement between the flap members and a work piece.

While flap wheel assemblies of the type described above can provide uniform finishing effects when used on planar surfaces, they are not as effective when used to finish arcuate convex surfaces such as a generally cylindrically convex metal cover for a casket or a side panel for an automobile.

An arcuate convex surface 10 has been finished using a flap wheel assembly 11 (illustrated in FIG. 1 of the drawing) including flaps 12 disposed parallel to an axis 13 of a cylindrical hub 14, which flaps 12 have projecting portions shaped to provide distal edges 15 that correspond to the arcuate shape of the surface 10 to be finished. The central cross sections of such flaps 12 are more stiff than their end cross sections, however, so that a uniform finish may not be achieved across the width of the arcuate convex surface 10. Also, there is little projecting flap material along the central cross sections of the flaps 12 so that the flaps 12 wear out quickly compared to flaps that have uniform widths along their lengths. An arcuate convex surface 10 has also been finished using a flap wheel assembly 16 (illustrated in FIG. 2 of the drawing) including flaps 17 disposed parallel to an axis 18 of a hub 19, which the flaps 17 are of of uniform width and are arcuate along their entire lengths to provide distal edges 20 that generally correspond to the shape of the surface 10 to be finished, and the central cross section of the hub 19 is reduced in diameter to receive the uniform width of the flaps 17. While the flap wheel assembly 16 produces suitable finishing results, such arcuate flaps 17 are specialty items that are suitable for use on only a small range of arcuate surfaces and can not also be used on cylindrical hubs intended to finish planar surfaces. Thus their use would significantly increase the different types of flaps that must be made and stored. Also, more waste of materials is incurred in the production such arcuate flaps 17 than in the production of rectangular flaps.

DISCLOSURE OF INVENTION

The present invention provides a flap wheel assembly that can use conventional rectangular flaps to uniformly finish arcuate or generally cylindrically convex surfaces.

According to the present invention there is provided a central hub for a flap wheel assembly in the shape of at least a part of a hyperboloid of revolution of one sheet, which hyperboloid has an axis, a central cross section perpendicular to the axis having a generally circular periphery of a first diameter around the axis, opposite circular end cross sections perpendicular to the axis that are axially spaced on opposite sides of its central cross section and have circular peripheries around the axis of second diameters substantially larger than the diameter of its central cross section, a peripheral surface comprising a multiplicity of generally straight elongate surface segments extending between the peripheries of the end cross sections across and contacting the periphery of its central cross section each crossing its central cross section at a different radius of the central cross section from the axis and being disposed at the same angle with respect to the axis measured about the radius crossed by the surface segment. The part has end surfaces generally at right angles to the axis and includes essentially all of the one sheeted hyperboloid of revolution between the end surfaces. The hub also has a plurality of holding means along and generally parallel to the segments each adapted for holding a straight edge portion of a generally rectangular flap member with the width of the flap member projecting outwardly of the hub to afford, upon rotation of the hub about the axis, engaging distal portions of the flap member with a curved or arcuate convex surface generally uniformly along the length of the flap member.

Such a central hub for a flap wheel assembly can be a part of the hyperboloid of revolution of one sheet including its central cross section in which case its end surfaces can be of the same or of different diameters, or can be a part of the hyperboloid of revolution of one sheet between its central cross section and one of its end cross sections so that the end surfaces of the part are of different diameters, whichever form more closely approximates the shape of a surface to be abraded.

The holding means preferably is provided by a plurality of straight elongate slots spaced around the periphery, with each slot opening through and extending along and parallel to one of the segments between the end surfaces and being larger in cross sectional area at a location spaced from the peripheral surface than adjacent the peripheral surface so that a root portion of a conventional rectangular flap may be secured in the slot.

Hubs according to the present invention afford progressive relatively quiet engagement of distal portions of the rectangular flap members with a curved convex surface generally uniformly along the lengths of the flap members so that wear of the flap members will be generally uniform along their lengths.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
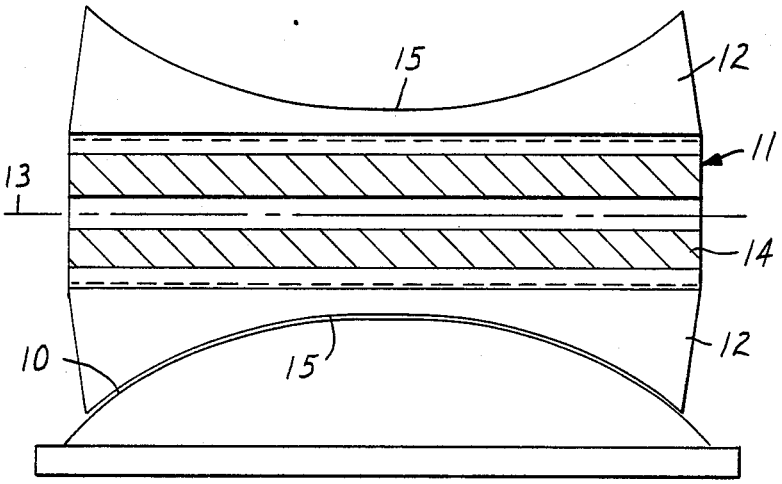
FIG. 1 PRIOR ART
FIG. 1 is a longitudinal sectional view of the flap wheel assembly 11 described above that has been used to finish generally cylindrically convex surfaces.
Figure 2:
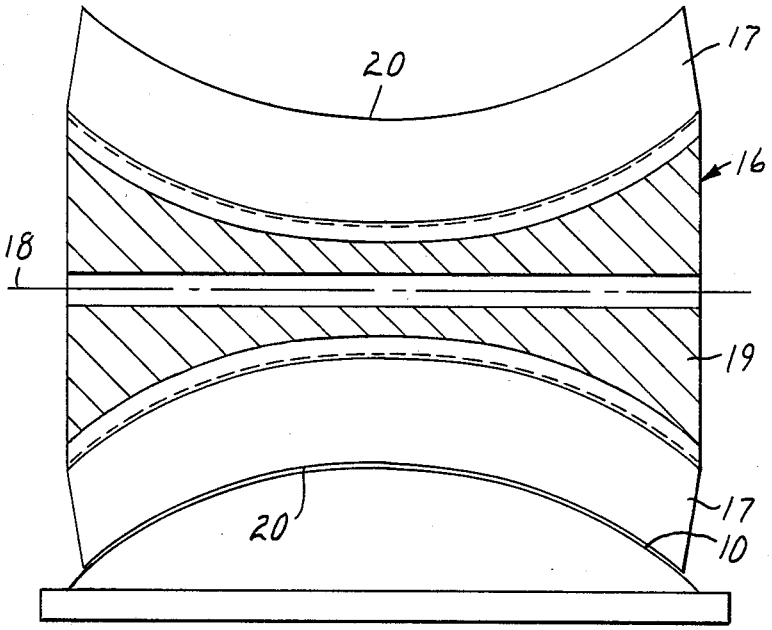
FIG. 2 PRIOR ART
FIG. 2 is a longitudinal sectional view of the flap wheel assembly 16 described above that has been used to finish generally cylindrically convex surfaces.

Referring now to FIGS. 3 through 6 of the drawing, there is shown a first embodiment of a flap wheel assembly 30 according to the present invention and/or a hub 32 according to the present invention that is included in the flap wheel assembly 30.

Generally the flap wheel assembly 30 comprises the novel hub 32 that is generally in the shape of a hyperboloid of revolution of one sheet, has an axis 33, and a through cylindrical bore 34 around the axis through which a drive spindle (not shown) on an abrading machine may be positioned to rotate the hub 32 about its axis 33. The hub 32 has a central cross section 36 perpendicular to its axis 33, which central cross section 36 has a circular periphery 38 around the axis 33 of a first diameter which is the minimum diameter of the hub 32; and has opposite circular end cross sections 39 and 40 perpendicular to and around the axis 33, which end cross sections 39 and 40 are equally axially spaced on opposite sides of the central cross section 36 and have circular peripheries 42 and 43 respectively of second diameters that are the same dimension and are substantially larger than the diameter of the circular periphery 38 of the central cross section 36. The hub has end surfaces 44*a* and 44*b* at the end cross sections 39 and 40 respectively, and has an overall peripheral surface 45 comprising a multiplicity of straight elongate surface segments (two of which are indicated by a dotted outline and the reference numeral 46 in FIG. 3) extending between the peripheries 42 and 43 of the end cross sections 39 and 40 across and contacting the periphery 38 of the central cross section 36, each of which surface segments 46 crosses the central cross section 36 at a different radius from the axis 33 of the central cross section 36 and is disposed at the same angle with respect to the axis 33 of the hub 32 measured about the radius crossed by the surface segment 46. The surface segments 46 each may be slightly cylindrically convex in transverse cross section, and are not easily visually identifiable on the peripheral surface 45 of the hub 32 as they each smoothly blend into other surface segments to form the peripheral surface 45 of the hub 32 that has the shape of the hyperboloid of revolution.

The hub 32 also has a plurality of attachment means along and generally parallel to its surface segments 46, each of which attachment means is adapted for holding a straight edge portion 50 of a generally rectangular flap member 52 with the width of the flap member 52 projecting outwardly of the hub 32 to afford, upon rotation of the hub 32 about its axis 33, engagement of distal portions of the flap member 52 with a generally cylindrically convex surface 54. The attachment means preferably is provided by a plurality of straight elongate slots 56 spaced around the peripheral surface 45, each slot 56 opening through and extending along one of the surface segments 46 between the end cross sections 39 and 40 and having a larger portion 57 spaced from the peripheral surface 45 of the hub 32 that is larger in cross sectional area than the portion of the slot 56 at the peripheral surface 45 (i.e., the slots 56 may be key-hole shaped in cross section as illustrated, or may have the cross sectional shape of a pyramid with its apex at the peripheral surface 45) so that a conventional loop-like root portion 58 of the rectangular flap member 52 extending along its edge portion 50 may be secured in the slot 56 by positioning a straight cylindrical polymeric rod 59 within the part of the root portion 58 in the larger portion 57 of the slot 56. Such a hub 32 affords progressive relatively quiet engagement of the distal portions of the rectangular flap members 52 with the generally cylindrically convex surface 54 generally uniformly along the lengths of the flap members 52 as the hub is rotated about its axis. Thus, wear of the distal end cross sections of the flap members 52 will be generally uniform along their lengths.

The flap members 52 are of a type commercially available as RX segments from Minnesota Mining and Manufacturing Company, St. Paul, Minn., in a wide variety of widths, lengths and grades which comprise a rectangular pad of coated abrasive sheets attached together by staples along its edge portion 50, having slits from and at right angles to their edges opposite the edge portion 50, and having end parts of the root portion 58 attached by the staples between sheets of abrasive in the pad with the central cross section of the root portion 58 projecting away from the aligned edges of the abrasive sheets of the pad so that it may be positioned in the slot 56 and held in the slot by the rod 59.

Figure 7:
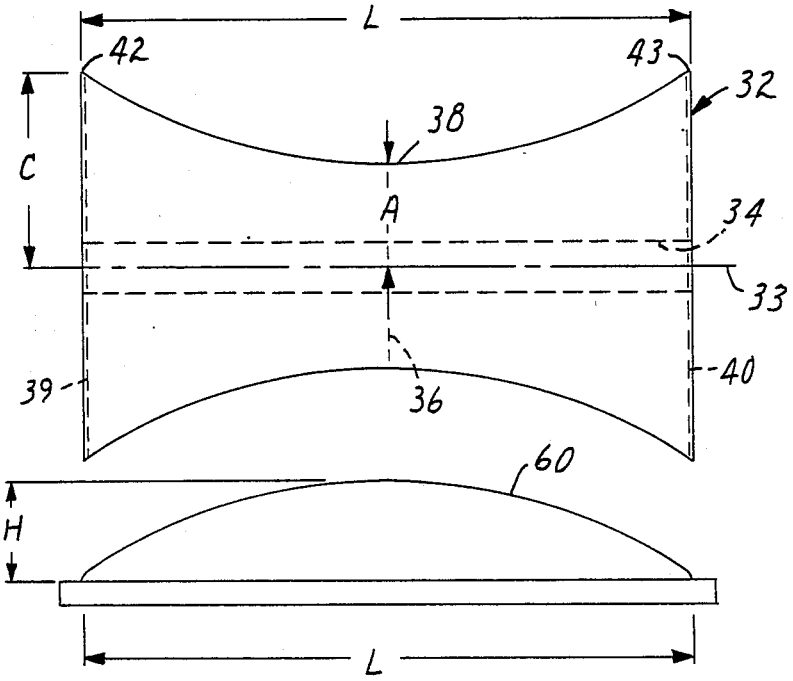
FIGS. 7 and 8 help to illustrate the structure and the mathematics involved in making the hub of FIG. 3.
Figure 8:
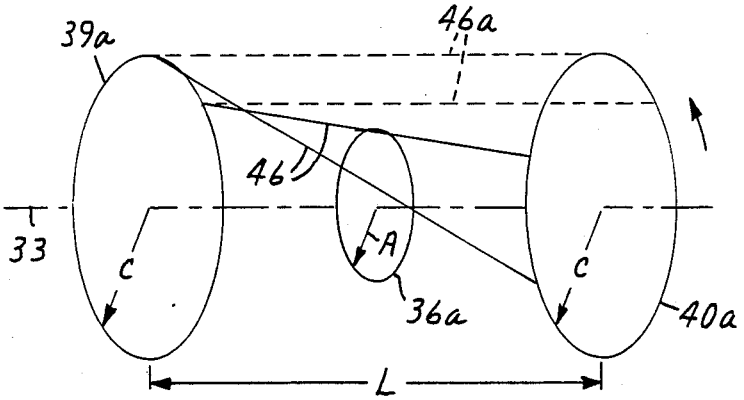

FIGS. 7 and 8 illustrate structural and mathematical relationships between the surface segments 46 or the slots 56 and the axis 33 of the hub 32 that can be used in making a hub 32 adapted for use in a flap wheel assembly 30 used to abrade or finish an arcuate convex surface such as a generally cylindrically convex surface 60 illustrated in FIG. 7. The surface 60 illustrated in FIG. 7 has a height dimension H and a length dimension L. Thus, a hub 32 adapted to finish that surface 60 will have an axial length L, a radius A for its circular periphery 38 around its central cross section 36 (which is the minimum radius for the hub 32) that is enough larger (e.g., about 2 inches larger) than the radius of the bore 34 to insure that even at the slots 56 the hub will have sufficient structural strength; and a radius C at the circular peripheries 42 and 43 around the end cross sections 39 and 40 that is equal to A+H.

Conceptually, as illustrated in FIG. 8, the shape of the peripheral surface 45 of the hub 32 can be developed by initially supporting a pair of discs 39*a* and 40*a* of radius C that represent the end cross sections 39 and 40 coaxially on the axis 33 with a spacing L between the discs 39*a* and 40*a*, and attaching circumferentially spaced elastic strings 46*a* between their peripheries with the strings 46*a* initially extending parallel to the axis 33 to define a cylindrical periphery, two of which axially parallel strings 46*a* are illustrated in dotted outline in FIG. 8. At least one of the discs (as illustrated, the disc 40*a*) is then rotated on the axis 33 relative to the other disc so that the strings 46*a* (which are stretchable and remain straight) become disposed at uniform angles to the axis 33 and define at their midpoints between the discs 39*a* and 40*a* a circle 36*a* of a smaller diameter than that of the discs 39*a* and 40*a* with each string 46*a* crossing at a different radius of that smaller circle 36*a*. Relative rotation of the discs 39*a* and 40*a* is continued until that defined circle 36*a* has the desired radius A for the central cross section 36, whereupon the stings 46*a* together define the peripheral surface 45, and each of the strings 46*a* represents one straight surface segment 46 that helps to define the peripheral surface 45 and along which a slot 56 or other means may be positioned to attach a flap member 52.

The hub 32 can be formed on a milling machine that can both rotate a blank about an axis that will become the axis 33 of the hub 32, and move a cutter radially of that axis in a plane defined by the cutter and the axis while the cutter is either moved along the axis in that plane or the axis is moved relative to the cutter in that plane. Assuming such a cutter is started at any point on the periphery of the end cross section 39, the following formulas provide at any distance x from that point on the end cross section 39 both the length r of the radius from the axis 33 and the angle that the blank must be rotated from its initial position to move the cutter along a straight surface segment 46 starting at that point.

$$r = \sqrt{(A^2 - C^2)\left(\frac{2x}{L} - 1\right)^2 + C^2}$$

$$\Theta = \cos^{-1}\left(\frac{A^2\left(1 - \frac{2x}{L}\right) + C^2\frac{2x}{L}}{Ar}\right)$$

The peripheral surface 45 of the hub 32 is formed by a large number of cutter passes of the type described above each starting at a different point on the periphery of the end cross section 39. After the peripheral surface 45 is thus formed, the slots 56, which each should be straight and each should be aligned with and cross a different radius of the hub 32 at its central cross section 36, can then be formed by the use of a saw or cutter moved between the ends of the hub in straight lines along spaced surface segments 46 with the hub in a fixed position and with the straight path along which the cutter moves being at at a right angle to the radius of the central cross section 36 it crosses. This path of the cutter will be at an angle with Θ respect to the axis 33 calculated by the formula:

$$\Theta = \tan^{-1}\frac{2}{L}\sqrt{A^2 - C^2}$$

Forming straight slots 56 may be more important than exact locations of the surface segments 46 since the lengths of the the root portions of the flap members 52 can allow some irregularities along the peripheral surface 45 without effecting operation of the flap wheel assembly 30.

As what may be a preferred alternative to the approach described above, the peripheral surface 54 for the hub 32 may be formed by first forming a cylindrical blank having the desired axial length L and radius C, and then passing a cutter between its periphery at its ends along a multiplicity of straight paths each at a right angle to and crossing a different radius of the hub 32 at its central cross section 36, with each path disposed at an angle with respect to the axis of the cylindrical blank measured about the radius of the central cross section 36 the path crosses calculated by the formula given above for the slots 56.

The curve of the peripheral surface 45 as viewed along a longitudinal section of the hub 32 is not circular, but has larger radii of curvature adjacent the end cross sections 39 and 40 than adjacent its central cross section 36; the general formula for that radius of curvature R at any position x along the axis 33 from the end cross section 39 being:

$$R = \left(\frac{L}{2}\right)^2 \frac{1}{(C^2 - A^2)A^2}\left[A^2 + X^2(C^2 - A^2)\left(\frac{2}{L}\right)^2\left(1 + (C^2 - A^2)\left(\frac{2}{L}\right)^2\right)\right]^{3/2}$$

The difference between the radii of curvature adjacent the end cross sections 39 and 40 compared to the radius of curvature adjacent the central cross section 36 can be increased by making the radius A very small compared to the radius C (i.e., making the overall diameter of the hub as small as possible for a given difference between A and C), or decreased by making the difference between the radii A and C small compared to the radius C (i.e., making the overall diameter of the hub much larger than necessary for a given difference between A and C), either of which approaches or a compromise therebetween may be useful to match the curvature of the peripheral surface 45 to the shape of an arcuate convex surface to be abraded or finished. The extension of the flap members will decrease the effect of the difference between the radii of curvature adjacent the end cross sections 39 and 40 compared to the radius of curvature adjacent the central cross section 36 and make the portion of the flap members that contact a surface slightly more circular.

Figure 3:
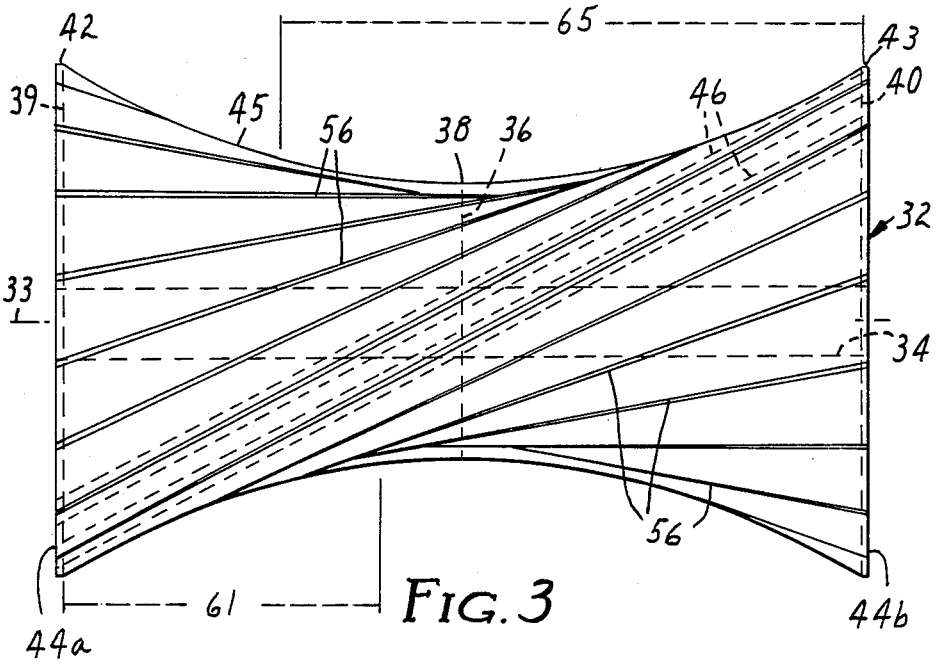
FIG. 3 is a side view of a hub according to the present invention for a flap wheel assembly that is generally in the shape of a hyperboloid of revolution of one sheet and can be used to finish generally cylindrically convex surfaces.
Figure 6:
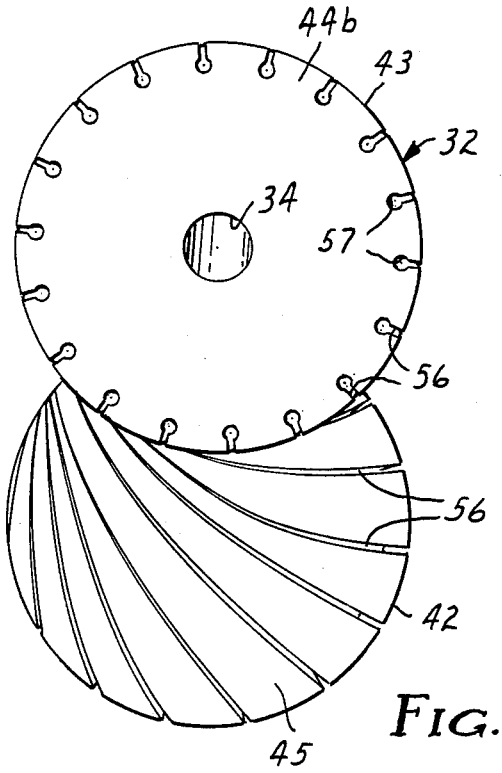
FIG. 6 is a reduced end view of the hub of FIG. 3 taken in line with one of a plurality of straight slots in which flap members may be attached along the periphery of the hub.
Figure 4:
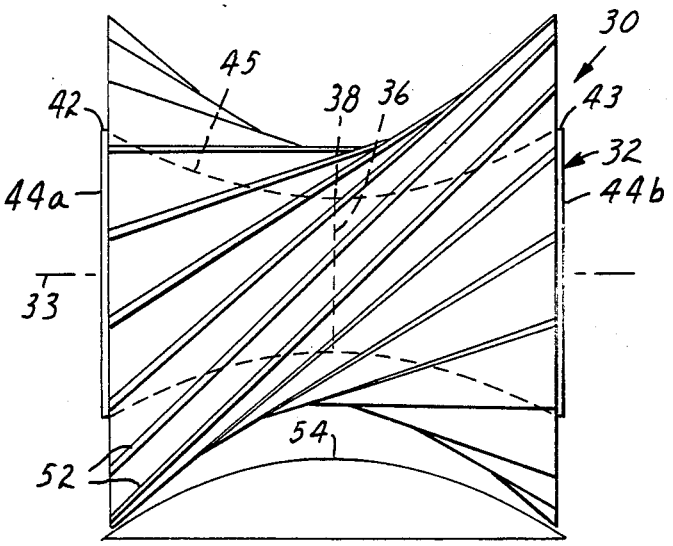
FIG. 4 is a reduced side view of a flap wheel assembly according to the present invention including the hub of FIG. 3 and a plurality of flap members attached around the hub.
Figure 5:
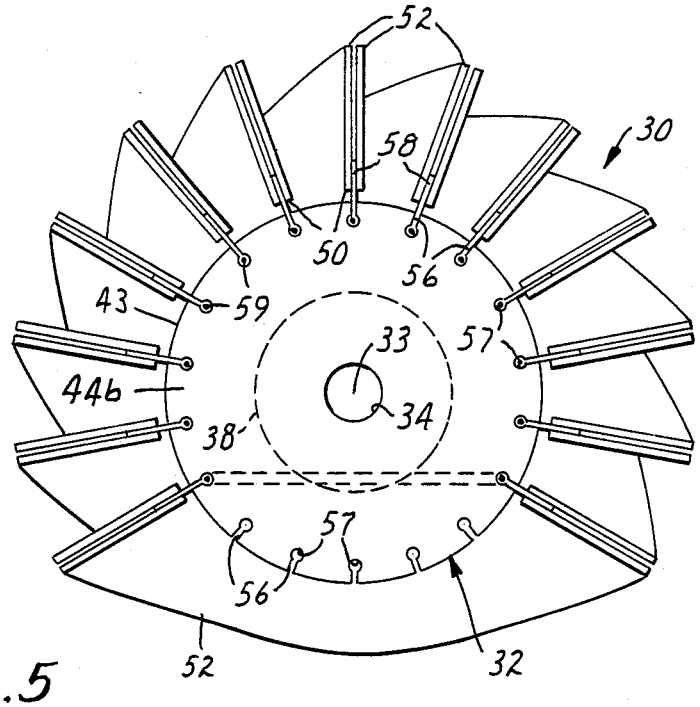
FIG. 5 is an enlarged end view of the flap wheel assembly of FIG. 4 from which five of the flap members have been removed.
Figure 9:
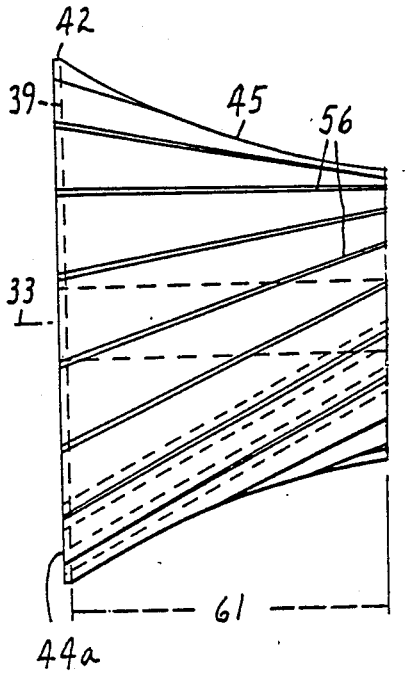
FIGS. 9 and 10 are side views of hubs according to the present invention for a flap wheel assembly, which hubs are generally in the shapes of only parts of a hyperboloid of revolution of one sheet.
Figure 10:
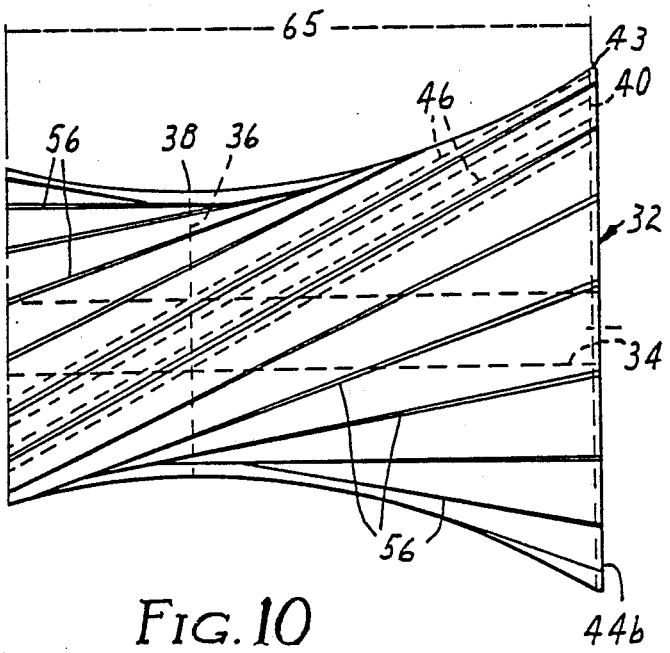

Also, in order to match the curvature of the peripheral surface 45 to the shape of an arcuate convex surface to be abraded only part of the one sheeted hyperboloid of revolution between the end cross sections 39 and 40 may be used to form the hub, such as that part 61 designated between the spaced parallel lines in FIG. 3 and illustrated in FIG. 9, which part 61 would have end surfaces perpendicular to axis 33 of different diameters lying between the central cross section 36 and the end cross section 39 of the hyperboloid of revolution and would include essentially all of the hyperboloid of revolution between those end surfaces; or that part 65 designated between the spaced parallel lines in FIG. 3 and illustrated in FIG. 10 which part 65 would have end surfaces of different diameters perpendicular to the axis 33 on opposite sides of the central cross section 36 of the hyperboloid of revolution and would include essentially all of the hyperboloid of revolution between those end surfaces. Also, to evenly finish a surface, a hub provided by such a part 61 or 65 of the one sheeted hyperboloid of revolution might be rotated about an axis that is not parallel with a conveyor surface by which the arcuate convex surface being finished is moved past a flap wheel assembly in which the hub is included.

The present invention has now been described with reference to one embodiment and several possible modifications thereof. It will be apparent to those skilled in the art that many changes can be made in the embodiment and modifications described without departing from the scope of the present invention. Thus the scope of the present invention should not be limited to the structures described in this application, but only by structures described by the language of the claims and the equivalents of those structures.

I claim:

1. A hub for a flap wheel assembly, said hub having an axis, a central cross section perpendicular to said axis having a generally circular periphery of a first diameter around said axis, opposite circular end cross sections perpendicular to said axis and axially spaced on opposite sides of said central cross section and having circular peripheries around said axis of second diameters substantially larger than the diameter of said central cross section, a peripheral surface comprising a multiplicity of generally straight elongate surface segments extending between the peripheries of said end cross sections across and contacting the periphery of said central cross section each crossing said central cross section at a different radius of said central cross section from said axis and being disposed at the same angle with respect to said axis measured about the radius crossed by the surface segment; said hub having a plurality of straight elongate slots spaced around said periphery, each slot opening through and extending parallel to and along one of said segments between said end cross sections and being larger in cross sectional area at a location spaced from said peripheral surface than adjacent said peripheral surface.

2. A hub for a flap wheel assembly, said hub having an axis, a central cross section perpendicular to said axis having a circular periphery of a first diameter around said axis, opposite circular end cross sections perpendicular to said axis, axially spaced on opposite sides of said central cross section and having circular peripheries around said axis of second diameters substantially larger than the diameter of said central cross section, a peripheral surface comprising a multiplicity of straight elongate surface segment extending between the peripheries of said end cross sections across and contacting the periphery of said central cross section each crossing said central cross section at a different radius of said central cross section from said axis and being disposed at the same angle with respect to said axis measured about the radius crossed by the surface segment; said hub having a plurality of means along and generally parallel to said segments each adapted for holding a straight edge portion of a generally rectangular flap member with the width of said flap member projecting outwardly of said hub to afford, upon rotation of said hub about said axis, engaging distal portions of said flap member with a generally cylindrically convex surface generally uniformly along the length of said flap member.

3. A flap wheel assembly comprising:

a hub, said hub having an axis, a central cross section perpendicular to said axis having a circular periphery of a first diameter around said axis, opposite circular end cross section perpendicular to said axis, axially spaced on opposite sides of said central cross section and having circular peripheries around said axis of second diameters substantially larger than the diameter of said central cross section, a peripheral surface comprising a multiplicity of straight elongate surface segments extending between the peripheries of said end cross sections across and contacting the periphery of said central cross section each crossing at a different radius of said central cross section from said axis and being disposed at the same angle with respect to said axis measured about the radius crossed by the surface segment;

a plurality of rectangular flap members each having a generally uniform width and a straight edge portion of a length about equal to the length of said segments; and means along and generally parallel to said segments for holding the straight edge portions of said flap members in spaced relationship around the peripheral surface of said hub with the width of said flap members projecting outwardly of said hub to afford, upon rotation of said hub, engaging distal portions of said flap members with a generally cylindrically convex surface generally uniformly along the lengths of said flap members.

4. A hub for a flap wheel assembly, said hub comprising at least a part of a hyperboloid of revolution of one sheet having an axis, a central cross section perpendicular to said axis having a generally circular periphery of a first diameter around said axis, opposite circular end cross sections perpendicular to said axis, axially spaced on opposite sides of said central cross section and having circular peripheries around said axis of second diameters substantially larger than the diameter of said central cross section, a peripheral surface comprising a multiplicity of generally straight elongate surface segments extending between the peripheries of said end cross sections across and contacting the periphery of said circular central each crossing said central cross section at a different radius of said central cross section from said axis and being disposed at the same angle with respect to said axis measured about the radius crossed by the surface segment, said part having end surfaces generally at right angles to said axis and including essentially all of the hyperboloid of revolution between said end surfaces; said hub having a plurality of straight elongate slots spaced around said periphery, each slot opening through and extending parallel to and along one of said segments between said end surfaces and being larger in cross sectional area at a location spaced from said peripheral surface than adjacent said peripheral surface.

5. A hub for a flap wheel assembly according to claim 4 wherein the end surfaces of said part are both between the central cross section and one of said end cross sections of said hyperboloid of revolution.

6. A hub for a flap wheel assembly according to claim 4 wherein said end surfaces are on opposite sides of the central cross section of said hyperboloid of revolution, and are of different diameters.

7. A hub for a flap wheel assembly, said hub comprising at least a part of a hyperboloid of revolution of one sheet having an axis, a central cross section perpendicular to said axis having a generally circular periphery of a first diameter around said axis, opposite circular end cross sections perpendicular to said axis, axially spaced on opposite sides of said central cross section and having circular peripheries around said axis of second diameters substantially larger than the diameter of said central cross section, a peripheral surface comprising a multiplicity of generally straight elongate surface segments extending between the peripheries of said end cross sections across and contacting the periphery of said circular central each crossing said central cross section at a different radius of said central cross section from said axis and being disposed at the same angle with respect to said axis measured about the radius crossed by the surface segment, said part having end surfaces at generally right angles to said axis and including essentially all of the hyperboloid of revolution between said end surfaces; said hub having a plurality of means along and generally parallel to said segments each adapted for holding a straight edge portion of a generally rectangular flap member with the width of said flap member projecting outwardly of said hub to afford, upon rotation of said hub about said axis, engaging distal portions of said flap member with an arcuate convex surface generally uniformly along the length of said flap member.

8. A central hub for a flap wheel assembly according to claim 7 wherein the end surfaces of said part are both between the central cross section and one of said end cross sections of said hyperboloid of revolution and are of different diameters.

9. A central hub for a flap wheel assembly according to claim 7 wherein said end surfaces are on opposite sides of the central cross section of said hyperboloid of revolution, and said end surfaces are of different diameters.

* * * * *